United States Patent [19]

Wolner

[11] Patent Number: 4,657,110

[45] Date of Patent: Apr. 14, 1987

[54] INERTIA ROPE GRAB

[75] Inventor: J. Thomas Wolner, Red Wing, Minn.

[73] Assignee: D B Industries, Inc., Red Wing, Minn.

[21] Appl. No.: 679,624

[22] Filed: Dec. 10, 1984

[51] Int. Cl.[4] ..... A62B 1/14

[52] U.S. Cl. ..... 182/5; 182/192; 188/65.2

[58] Field of Search ..... 182/5, 6, 7, 191, 192; 188/65.1, 65.2; 24/115 L, 136 L, 115 M

[56] References Cited

U.S. PATENT DOCUMENTS

| | | | |
|---|---|---|---|
| 2,606,350 | 8/1952 | French | 24/115 L |
| 3,177,543 | 4/1965 | Fountain | 24/115 L |
| 3,876,036 | 4/1975 | Sweet | 182/5 X |
| 4,071,926 | 2/1978 | Sweet . | |
| 4,077,094 | 3/1978 | Swager | 182/5 X |
| 4,521,000 | 6/1985 | Dodge, Jr. | 182/5 X |
| 4,542,884 | 9/1985 | Dodge, Jr. | 182/5 X |

FOREIGN PATENT DOCUMENTS

| | | | |
|---|---|---|---|
| 2812073 | 9/1979 | Fed. Rep. of Germany | 182/5 |

*Primary Examiner*—Ramon S. Britts
*Assistant Examiner*—Karen J. Chotkowski
*Attorney, Agent, or Firm*—Williamson, Bains, Moore & Hansen

[57] ABSTRACT

A safety device is provided for removably fastening to a safety line a rope grab which contains both inertia and positive locking features. A roller is provided in angled guide tracks to provide an inertia locking effect while a pivot arm can bear against the roller to provide positive locking as well.

10 Claims, 3 Drawing Figures

INERTIA ROPE GRAB

BACKGROUND OF THE INVENTION

Both in response to government regulations and a general desire for safety, rope grabs or similar devices have become a requirement for workers working in elevated positions. Such rope grabs typically fasten to a safety belt or safety harness fastened about the worker via a lanyard. The rope grab is then attached to a safety line which is in turn fastened independently of the scaffold or other movable structure upon which the worker may be working.

Prior art devices have proven less than totally acceptable for several different reasons. Some devices require the worker to manually adjust the rope grab on the safety line as the worker moves vertically. Other known prior art devices merely use a pivoting arm which is attached to the lanyard at one end and at the other end which bears against the rope. Such a device utilizes the weight of the falling worker to pivot the arm into contact with the safety line in order to provide a braking effect. It can be appreciated in such a device, however, that if the rope grab freely slides down the safety line at a rate equal to the speed of the falling worker, no stopping force can be applied. One known prior art device does provide a system whereby both inertia stopping and positive actuated stopping are provided. This device, however, does not allow the rope grab to be placed on a safety line intermediate the ends of the safety line. Due to the tubular nature of such a prior art device, the rope grab must be placed over the end of the rope. Such a device is often less than desirable as it is commonly necessary to attach the rope grab at some point intermediate the ends of the safety line.

Therefore, it is an object of this invention to provide a rope grab which may be easily attached to the safety line intermediate the ends thereof. It is a further object of this invention to provide a rope grab which utilizes both inertia and direct actuation for stopping. It is yet another object of this invention to provide a rope grab which does not cause damage to the safety line. Still another object of this invention is to provide a rope grab which prevents roll-out of the lanyard attaching hook. It is yet another object of this invention to provide a rope grab wherein the abruptness with which the braking force is applied may be varied.

SUMMARY OF THE INVENTION

The invention is directed toward an improved rope grab safety device which can be quickly and easily installed for sliding movement on a safety line to desired vertical positions of use, and which will automatically operate to firmly grab the safety line to catch and support a person to whom it is attached, if the person should fall from an elevated position along the safety line.

The basic objectives and advantages are realized by providing a mounting bracket with a safety line channel within which a roller is positioned at an angle for vertical movement toward the safety line. The roller is positioned between wall segments which define the safety line channel, the roller being mounted in tracks which slant upwardly and toward the safety line. A retaining member is hingedly attached to the wall segments to provide a bearing surface against which the safety line is wedged by the roller.

A pivot arm is pivotably attached between the wall segments and has a first end to which a safety harness lanyard may be attached and a second end. The second end of the pivoting arm bears against the roller to force the roller into contact with the safety line. The pivot arm is movable between a first position wherein the pivot arm second end is free of contact with the stop roller and a second position wherein the pivot arm second end contacts the roller and forces it into contact with the safety line.

The pivot arm first end is formed by a forked pair of flat plates having a pin extending therebetween. A lanyard snap hook snaps over the pin. Due to the flat plates, and the pin extending therebetween, "roll-out" of the snap hook is prevented.

A stop is provided to contact the top edge of the pivot arm so as to limit the travel of the arm between the first and second positions. A spring is provided to bias the pivot arm toward the above-mentioned second position. An upper roller is located between the wall segments to help locate the safety line in the safety line channel.

During normal operation, the weight of the rope grab will cause the rope grab to slide downwardly on the safety line relative to the wearer thereby forcing the pivot arm upwardly into the first position. In this configuration, the grab may slide freely on the safety line thereby following the worker up or down without manipulation by the worker.

Should the worker fall, one or both mechanisms will serve to provide a braking action on the safety line to the worker. First of all, upon the initiation of a fall, the inertia of the roller itself will cause the roller to slide upwardly in the guide tracks toward the safety line by wedging the roller into the safety line and against the safety line retainer member. Also during falling, the pivot arm will be pulled downwardly from the first position toward the second position whereby the second end of the pivot arm will further force the stop roller against the safety line providing further braking action. The angle and length of the guide tracks serve to adjust the swiftness with which the decelerative force is applied.

DESCRIPTION OF THE PREFERRED EMBODIMENT

Figure 1:
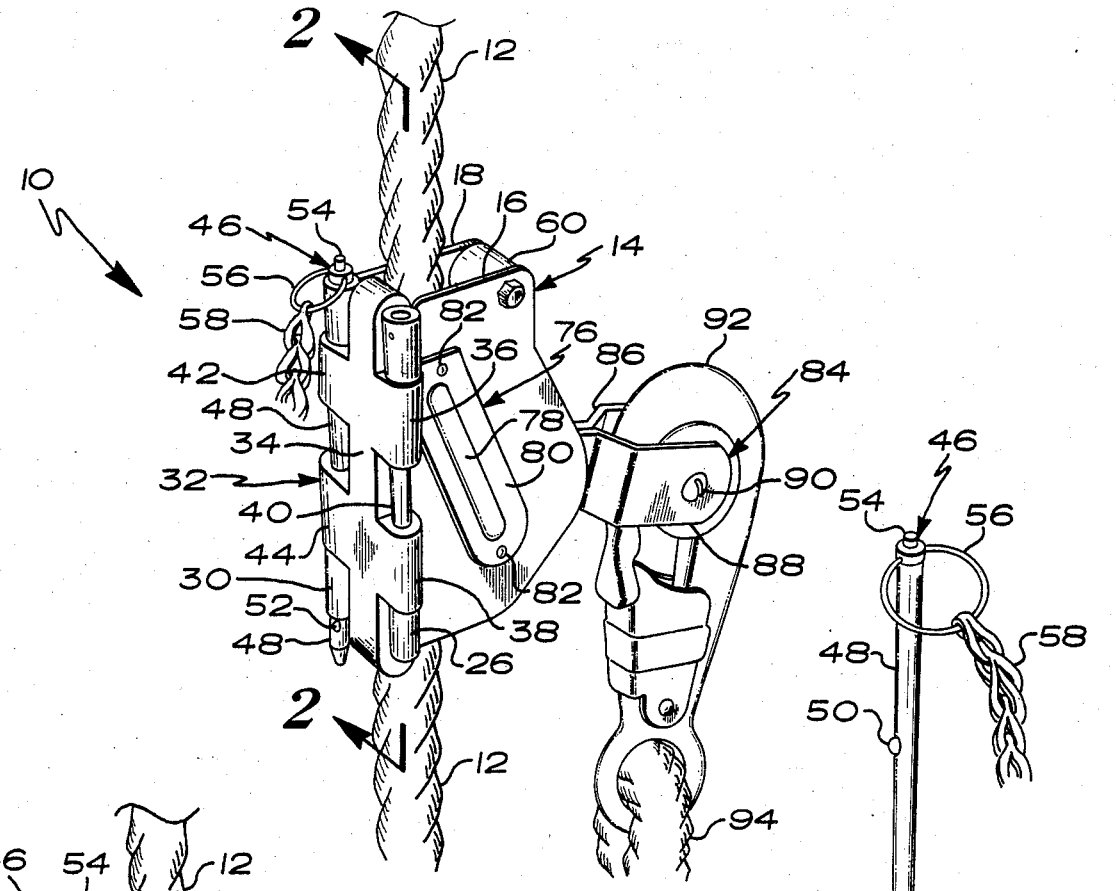
FIG. 1 is a perspective view showing the rope grab on a safety line.

The rope grab of the instant invention is generally designated 10 and is shown in all of the drawing figures. The rope grab 10 is generally designed for use on a safety line 12 which preferably is provided with a substantial counterweight at the bottom end thereof (not shown). Rope grab 10 is provided with a frame 14 formed by a pair of wall segments 16 and 18, respectively. Wall segments 16 and 18 have front edges 20 and 22 located thereon, respectively. Located on the front edge 20 of wall segment 16 are hinge tubes 24 and 26 which may be affixed thereto by welding or the like or may be integrally formed and rolled with the wall segment. Located on the front edge 22 of wall segment 18 are pin tubes 28 and 30 which may be attached or formed in a similar fashion.

Figure 3:
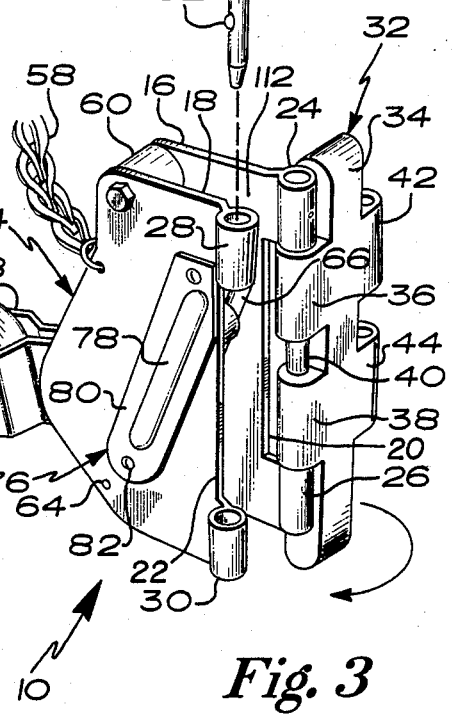
FIG. 3 is a perspective view showing the rope grab retaining member opened and the hinge pin removed.

A safety line retainer member 32 is shown in detail in FIG. 3 and is provided with a safety line contact surface 34 thereon. Extending from one side of retainer member 32 are hinge tubes 36 and 38. A pin 40 is used to provide a hinging action between retainer member 32 and frame 14. Pin tubes 42 and 44 extend from the other side of retainer member 32 and when swung closed in the direction indicated by the arrow in FIG. 3, line up directly between pin tubes 28 and 30 for reception of a closure pin 46.

Closure pin 46 is of a type generally known and is comprised of an elongated shaft 48 having detent balls 50 and 52 located thereon. Detent balls 50 and 52 are designed and spaced so as to be located just below the bottom end of pin tubes 42 and 30, respectively. A release button 54 is located on the top end of closure pin 46 for positively disengaging detent balls 50 and 52. A ring 56 is provided through shaft 48 for engagement with a chain 58 which is in turn attached to frame 14.

Figure 2:
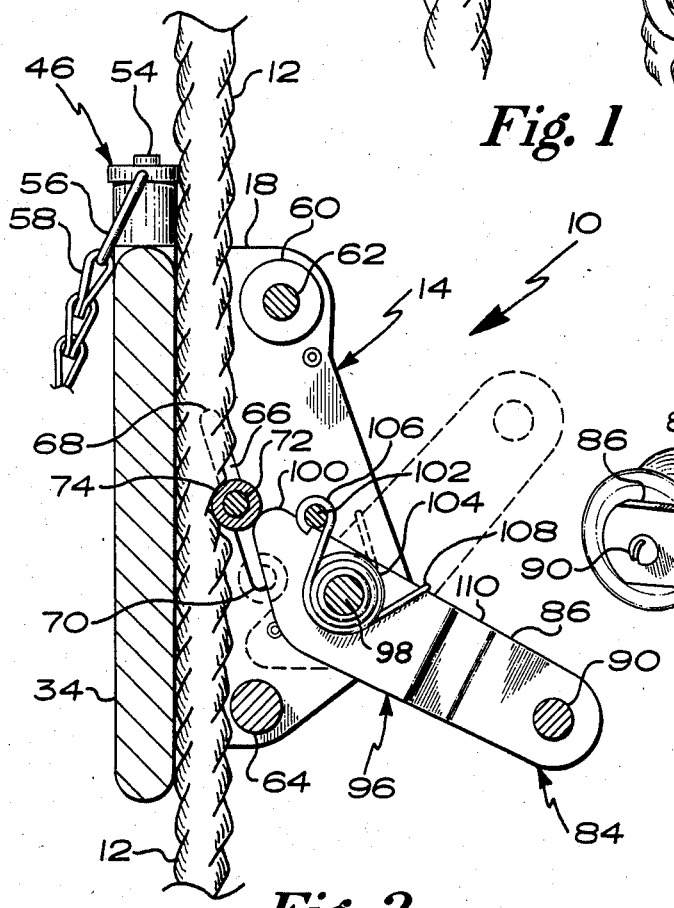
FIG. 2 is a sectional view taken alone line 2—2 of FIG. 1.

A nylon upper roller 60 is rotatably mounted on a shaft 62 which extends between wall segments 16 and 18 adjacent to the top thereof. Similarly, a solid rod 64 extends between wall segments 16 and 18 adjacent the bottom thereof. As can be seen particularly in FIG. 2, upper roller 60 and bottom rod 64 are spaced from contact surface 34 a distance slightly greater than the thickness of safety line 12.

A pair of guide tracks 66 is formed in wall segments 16 and 18 and slant upwardly toward retainer member 32. Guide tracks 66 are provided with upper ends 68 and lower ends 70. Slidably mounted in guide tracks 66 is a shaft 72 having a roller 74 located thereabout, roller 74 being located between wall segment 16 and 18 with shaft 72 extending therethrough. A shaft cover 76 is provided on the outer sides of wall segments 16 and 18. Shaft cover 76 is provided with a raised portion 78 which covers shaft 72 and prevents engagement thereof externally while surrounding plate 80 is utilized in conjunction with fasteners 82 to secure shaft cover 76 to the wall segments 16 and 18.

A pivot arm assembly 84 is formed from a pair of arm portions 86 and 88 which diverge adjacent the first end of pivot arm assembly 84 and are connected by a shaft 90 therebetween. A snap hook 92 in conjunction with lanyard 94 is snapped about shaft 90 and captured between arm portion 86 and 88. The flat nature of arm portions 86 and 88 and shaft 90 prevents roll-out of hook 92.

Arm portions 86 and 88 thereafter converge toward the second end of pivot arm 84 and pivot about a shaft 98 which extends between wall segments 16 and 18. The tip of the second end 100 of pivot arm 84 is shown contacting stop roller 74 in FIG. 2. A stop shaft 102 extends between wall segments 16 and 18 and serves to limit the travel of pivot arm 84 between its first and second positions, the first position shown in phantom in FIG. 2 and the second position shown in solid. A spring 104 having first and second ends 106 and 108 is utilized to bias pivot arm 84 into the second position. Spring first end 106 is wrapped about stop shaft 102 and the second end 108 engages the top edge 110 of pivot arm 84. Spring 104 is of a torsional type and wraps about shaft 98.

As can be seen in the drawing figures, a safety line channel is formed by wall segments 16 and 18, retaining member 32, upper roller 60 and rod 64.

While the preferred embodiment of the present invention has been described, it should be understood that various changes, adpations and modifications may be made therein without departing from the spirit of the invention and the scope of the appended claims.

What is claimed is:

1. A rope grab safety device for restrainably engaging a vertically extending safety line comprising:

a mounting bracket having spaced apart, vertically extending wall segments defining therebetween a vertical channel through which a safety line extends when the bracket is mounted in its upright position of use;

a safety line retainer member extending across said channel between said wall segments and cooperating therewith to contain a safety line within said channel;

a pair of guide tracks formed in said wall segments parallel to each other in opposed, spaced apart relation adjacent to said channel, said guide tracks being disposed at an angle to the vertical and extending upwardly and toward said retainer member, each said guide track having an upper end and a lower end;

a free-floating stop roller extending between said wall segments and having end extremities positioned in said guide tracks, whereby said roller may travel up and down in said guide tracks, said roller being positioned relative to said channel at a location wherein said stop roller will be closer to said retainer member at said track upper ends than the thickness of said line and further from said retainer member than said thickness at said track lower ends; and a pivot arm comprising first and and second ends with said first end comprising means for connection to a safety harness, said arm being pivotally mounted to said wall segments for movement between first and second positions, whereby an upward force on said pivot arm first end first locates said pivot arm in said first position free of any mechanical connection with said stop roller and thus with no restraining force being applied against a safety line within said channel, and said pivot arm being positioned relative to said stop roller to cause said pivot arm second end to contact and mechanically actuate said roller as said arm moves toward said second position thereby forcing said stop roller upwardly in said guide tracks and against said safety line to thereby restrainably engage said safety line between said roller and said retainer member.

2. The rope grab of claim 1 wherein said means for connection comprises:

first and second spaced parallel flat plates; and a pin extending between said plates for attachment of a safety harness around said pin and between said plates.

3. The rope grab of claim 1 further comprising means to bias said pivot arm toward said second position.

4. The rope grab of claim 1 further comprising stop means for limiting the travel of said pivot arm to said first and second positions.

5. The rope grab of claim 1 comprising an upper roller located between said wall segments above said guide tracks.

6. The rope grab of claim 1 wherein said retainer member is hingedly attached to said wall segments.

7. The rope grab of claim 6 wherein:

said retainer member has an elongated, vertically extending surface substantially coextensive with the vertical extent of said guide tracks, whereby a safety line may be restrainably engaged with increasing gripping action along the length of said vertically extending surface as said stop roller moves upwardly in said guide tracks toward said retainer member.

8. The rope grab of claim 1 wherein said stop roller has a smooth surface.

9. The rope grab of claim 1, and further including:

a cover plate on each of said wall segments of said mounting bracket disposed over said end extremities of said stop roller in covering relation thereto, whereby said roller cannot be manually held down by the user to avoid engagement with a safety rope.

10. The rope grab of claim 9 wherein:

each of said cover plates has an elongated, raised segment thereon which overlies and is coextensive with one of said guide tracks, with said end extremities of said stop roller being movably contained within said raised segments.

* * * * *